US007771288B2

(12) United States Patent
Gilbert et al.

(10) Patent No.: US 7,771,288 B2
(45) Date of Patent: Aug. 10, 2010

(54) GOLF CLUB HEAD WITH FACE INSERT

(75) Inventors: Peter J. Gilbert, Carlsbad, CA (US); M. Scott Burnett, Carlsbad, CA (US); Thomas O. Bennett, Carlsbad, CA (US)

(73) Assignee: Acushnet Company, Fairhaven, MA (US)

( * ) Notice: Subject to any disclaimer, the term of this patent is extended or adjusted under 35 U.S.C. 154(b) by 106 days.

(21) Appl. No.: 10/639,632

(22) Filed: Aug. 13, 2003

(65) Prior Publication Data

US 2005/0037859 A1 Feb. 17, 2005

(51) Int. Cl.
*A63B 53/04* (2006.01)

(52) U.S. Cl. ..... 473/324; 473/331; 473/342; 473/349; 473/350

(58) Field of Classification Search ..... 473/324, 473/342, 349
See application file for complete search history.

(56) References Cited

U.S. PATENT DOCUMENTS 3,692,306 A * 9/1972 Glover ..... 473/306
3,970,236 A * 7/1976 Rogers ..... 228/196
4,021,047 A * 5/1977 Mader ..... 473/345
4,027,885 A * 6/1977 Rogers ..... 473/342
4,252,262 A * 2/1981 Igarashi ..... 228/174
4,398,965 A * 8/1983 Campau ..... 148/522
4,749,197 A * 6/1988 Orlowski ..... 473/342
4,792,140 A * 12/1988 Yamaguchi et al. ..... 473/331
4,883,275 A * 11/1989 Boone ..... 473/334
5,024,437 A 6/1991 Anderson
5,062,638 A * 11/1991 Shira ..... 473/350
5,094,383 A 3/1992 Anderson et al. ..... 228/176
5,176,384 A * 1/1993 Sata et al. ..... 473/329
5,261,663 A 11/1993 Anderson
5,303,922 A * 4/1994 Lo ..... 473/330
5,344,140 A 9/1994 Anderson
5,370,750 A 12/1994 Novotny et al. ..... 38/44
5,431,396 A * 7/1995 Shieh ..... 473/329
5,509,660 A * 4/1996 Elmer ..... 473/288
5,620,382 A * 4/1997 Cho et al. ..... 473/331
5,643,103 A * 7/1997 Aizawa ..... 473/290
5,807,189 A 9/1998 Martin ..... 473/342
5,816,936 A * 10/1998 Aizawa et al. ..... 473/342
5,967,903 A * 10/1999 Cheng ..... 473/342

(Continued)

FOREIGN PATENT DOCUMENTS

JP 675537 10/1994

(Continued)

OTHER PUBLICATIONS

"General Properties of steels", Efunda Engineering Fundamentals.*

(Continued)

*Primary Examiner*—Sebastiano Passaniti
(74) *Attorney, Agent, or Firm*—Hanify & King, P.C.

(57) ABSTRACT

A golf club head is disclosed. The golf club head has a body member and a face insert formed of different materials. The body material is relatively soft and ductile to allow the club to be customized, and the face insert member is relatively hard and wear resistant to ensure that the face groove geometry remains substantially unaltered through use.

23 Claims, 3 Drawing Sheets

U.S. PATENT DOCUMENTS

| | | | | |
|---|---|---|---|---|
| 6,042,486 | A * | 3/2000 | Gallagher | 473/329 |
| 6,093,112 | A * | 7/2000 | Peters et al. | 473/291 |
| 6,220,971 | B1 * | 4/2001 | Takeda | 473/342 |
| 6,341,723 | B1 * | 1/2002 | Nakahara et al. | 228/215 |
| 6,428,427 | B1 | 8/2002 | Kosmatka | 473/349 |
| 6,494,789 | B2 * | 12/2002 | Chen | 473/324 |
| 6,638,179 | B2 * | 10/2003 | Yoshida | 473/324 |
| 6,645,086 | B1 * | 11/2003 | Chen | 473/335 |
| 6,723,279 | B1 * | 4/2004 | Withers et al. | 419/27 |
| 6,932,717 | B2 | 8/2005 | Hou | 473/332 |
| 2003/0119602 | A1 | 6/2003 | Kennedy, III et al. | 473/342 |
| 2003/0125126 | A1 | 7/2003 | Kosmatka | 473/329 |
| 2004/0171434 | A1 * | 9/2004 | Radcliffe et al. | 473/324 |
| 2004/0235584 | A1 | 11/2004 | Chao | 473/342 |

FOREIGN PATENT DOCUMENTS

| | | |
|---|---|---|
| JP | 10000251 | 1/1998 |
| JP | 11-57084 | 2/1999 |
| JP | 11-262548 | 9/1999 |
| JP | 11-267253 | 10/1999 |
| JP | 3069349 | 3/2000 |
| JP | 200212984 | 1/2002 |
| JP | 2003-102880 | 4/2003 |
| JP | 2003-102882 | 4/2003 |

OTHER PUBLICATIONS

ASTM G65-00, Standard Test Method for Measuring Abrasion Using the Dry Sand/Rubber Wheel Apparatus, Nov. 2000.

Non-Final Office Action dated Nov. 4, 2009 of corresponding U.S. Appl. No. 12/511,454.

Office Action dated Jul. 23, 2009 in related U.S. Appl. No. 10/993,426.

Final Office Action dated Jan. 25, 2010 of corresponding U.S. Appl. No. 10/993,426.

* cited by examiner

GOLF CLUB HEAD WITH FACE INSERT

BACKGROUND OF THE INVENTION

1. Field of the Invention

The present invention relates to a golf club head. In particular, the present invention relates to a golf club head having a body member and a face insert formed of different materials. More particularly, the present invention relates to a golf club head that allows for customization and provides adequate face wear resistance.

2. Description of the Related Art

Golf clubs are typically fabricated having standard values for lie angle, loft angle, face offset, etc. Individual golfers, however, typically require clubs having different dimensions than the standard values. To customize these clubs, the hosel portion, which is a socket in the club head into which the shaft is inserted, is typically bent to change the standard dimensions of the club head. This need for club manipulation requires that the club head be formed of a relatively soft, malleable material.

The club head face, which strikes the golf ball during use, typically has grooves formed therein. These grooves grip the golf ball and impart spin thereto. This spinning enhances the aerodynamic effect of the golf ball dimples, and allows a skilled golfer to control the flight profile of the ball while airborne and the behavior of the ball after landing. Normally through regular use, the golf club face, including the grooves, experiences significant wear. This wearing away or erosion of the club head face is exaggerated and promoted by the soft material required for club head customization, and results in the groove volume decreasing and the groove edges becoming rounded. Since groove design is critical for ensuring proper spin is applied to the golf ball, changes in groove geometry result in degraded performance.

Past attempts to increase the imparted ball spin or to improve face wear have included adding a coating to the club face. These coatings preserve surface roughness as they wear away. However, the coatings do not reduce the material wear from the face surface. Some tend to wear away relatively quickly through normal use, leaving the club head material exposed. Once exposed, the club head face material wears away and performance is compromised. Other attempts to reduce wear have included forming the entire club head of a wear-resistant material, such as a chrome plating. While these clubs are better at resisting face wear, they have the undesirable effect of effectively preventing club customization, since wear-resistant materials tend to have very low ductility and malleability.

Thus, what is needed is an improved golf club head that allows for customization and provides adequate face wear resistance.

SUMMARY OF THE INVENTION

The golf club head of the present invention includes a body comprising a first material and an insert comprising a second material. The first material is softer than the second material. The golf club head includes a sole. The sole material is harder than the body material, and the sole material is preferably the same as the insert material. The golf club head is preferably for an iron-type golf club.

The second material preferably has a wear resistance from approximately 40 to 0. More preferably, the second material has a wear resistance of approximately 35 to 0. The first material preferably has an elongation of greater than approximately 13%, and an ultimate elongation of approximately 15% to approximately 21%.

The insert preferably includes a strike face having grooves therein. The grooves have a width. The width changes less than approximately 40% upon blast testing. More preferably, the width changes less than approximately 30% upon blast testing, and still more preferably less than approximately 25% upon blast testing.

The first material preferably has a Rockwell C hardness of at most approximately 30. The second material preferably has a Rockwell C hardness of approximately 50 to approximately 55.

The first and second materials may be steels. The second material may preferably include approximately 1.40% to approximately 1.75% carbon and approximately 10.0% to approximately 18.0% chromium. More preferably, the second material includes approximately 1.50% to approximately 1.65% carbon and approximately 15.5% to approximately 16.5% chromium. Alternatively, the second material preferably comprises a ratio of percentage chromium to percentage carbon from approximately 10:1 to approximately 11:1.

DESCRIPTION OF THE DRAWINGS

The present invention is described with reference to the accompanying drawings, in which like reference characters reference like elements, and wherein.

DETAILED DESCRIPTION OF THE INVENTION

Figure 1:
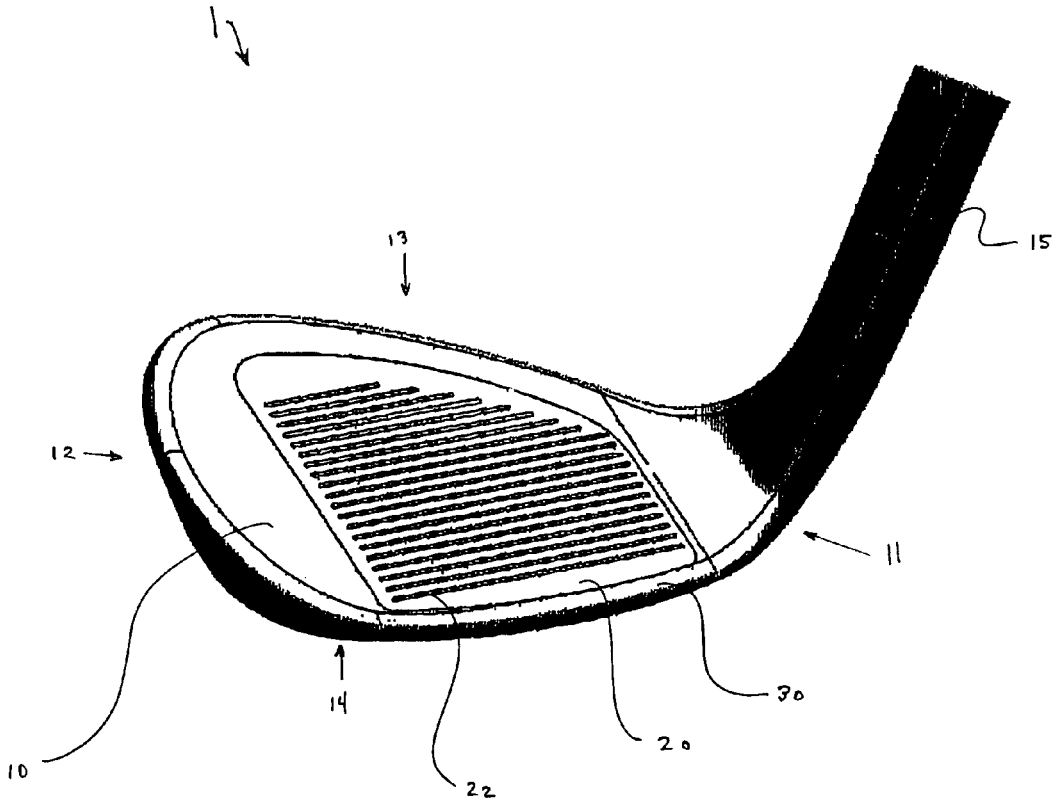
FIG. 1 illustrates a golf club head of the present invention.

FIG. 1 shows a golf club head 1 of the present invention. Golf club head 1 is preferably an iron-type club head, and includes a body 10 having a heel 11, toe 12, crown 13, and sole 14. A hosel 15 is provided in heel 11. A shaft (not shown) is coupled to club head 1 within hosel 15. Club head 1 further includes a strike face 20. The angle between strike face 20 and the ground when club head 1 is placed on a level surface is the loft angle. The vertical elevation of a golf shot is predominantly determined by the loft angle. The angle between the axis of hosel 15 and the longitudinal axis of sole 14 is the lie angle. The horizontal distance between the axis of hosel 15 and a central axis of club head 1, if any, is the club offset.

While golf club heads are typically manufactured having standard values for loft angle, lie angle, offset, and other dimensions, individual golfers often require modification of the club heads to suit their particular swing. For example, a golfer's swing may require his clubs to have a lie angle 2° greater than the standard value. To obtain the club dimensions required for an individual golfer, club head 1 is customized by altering the standard dimensions. This typically entails locking club head 1 in a vise or like device and bending hosel 15 to obtain the desired values for loft angle, lie angle, offset, etc. To facilitate this manipulation, club head 1 is formed of a first, relatively soft and malleable material.

Strike face 20 is used to contact golf balls during normal use. Strike face 20 includes grooves 22. Grooves 22 grip the golf ball and impart spin thereto. This spinning enhances the aerodynamic effect of the golf ball dimples, and allows a skilled golfer to control the flight profile of the ball while airborne and the behavior of the ball after landing. Repeated contacts of strike face 20 through routine use cause it and grooves 22 to wear away. To delay the wearing away of strike face 20 and to help ensure that the geometry of grooves 22 remains unaltered, strike face 20 is formed of a second material that resists wear. If a material is wear-resistant, it tends to be less ductile. Since ductility is desired for the material forming body 10, strike face 20 preferably is an insert that is coupled to body 10. Any known coupling means may be used, with adhesion and brazing being preferred.

The first material is a relatively soft, ductile material, and may be a material typically used to form golf clubs. Iron-type golf clubs are typically manufactured from carbon steel or a relatively soft stainless steel. Preferred carbon steels include 1025, 8620, and S20C, and preferred stainless steels include 431, 303, and 329. Forming body 10 of one of these materials allows for customization of club head 1 to obtain the required dimensions for a user's individual swing. These materials typically have an elongation of approximately 13% or more, and preferably within the range of approximately 15% to approximately 21%, when tested according to usual standards.

The second material is a wear-resistant material. A convenient method of categorizing and ranking material wear resistance is through ASTM G65, which is entitled "Standard Test Method for Measuring Abrasion Using the Dry Sand/Rubber Wheel Apparatus." Procedure A, which is a relatively severe test for metallic materials, is the preferred procedure. This test characterizes materials in terms of weight loss under a controlled set of laboratory conditions. A material sample is held against a rubber wheel under a specified force. While the sample is pressed against the wheel, the wheel is rotated at a specified rate of rotation and aggregate material is introduced at a specified flow rate at the wheel-sample contact area. After a specified time has elapsed, the sample is withdrawn and measured to determine the volume loss. Test results are reported as volume loss in cubic millimeters. Materials of higher abrasion or wear resistance will have a lower volume loss. Thus, a lower wear resistance number indicates better wear resistance. Typical golf club materials include cast stainless steel, which have a wear resistance of about 200, and carbon steels, which have a wear resistance of about 80. The second material of the present invention preferably has a wear resistance of 40 or less, and more preferably has a wear resistance of 35 or less.

Figure 2:
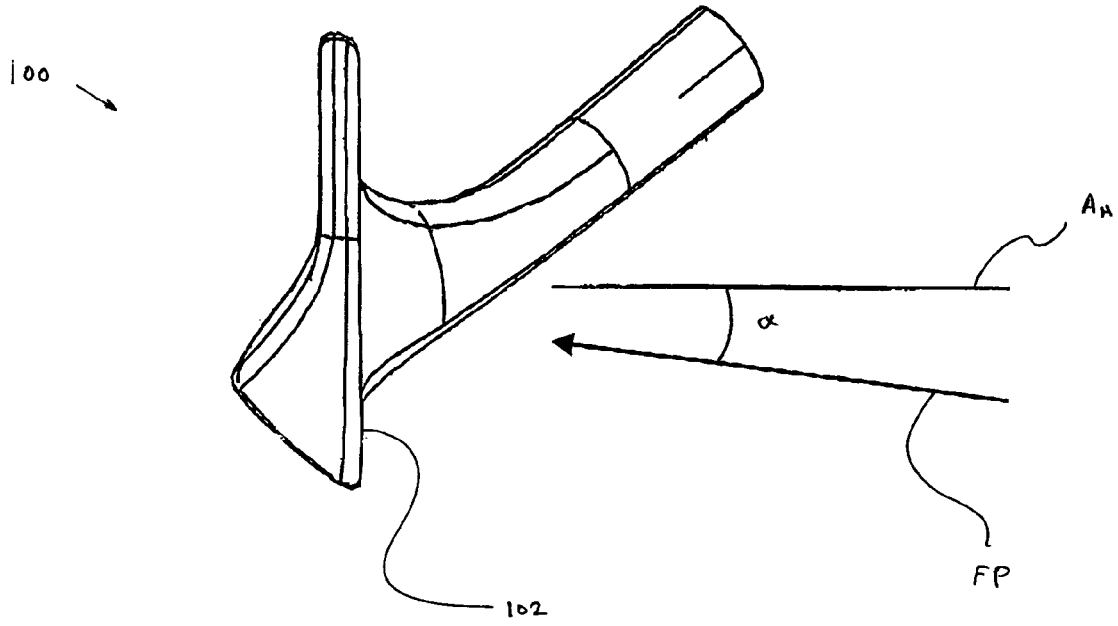
FIG. 2 illustrates a blast test configuration.

During development of the present invention, several clubs were subjected to blast testing. FIG. 2 illustrates the blast test configuration. A club head 100 was positioned and held in place with its face 102 being substantially vertical, or substantially perpendicular to a horizontal axis $A_H$. Aggregate material was impacted against face 102 along a flow path FP at an angle $\alpha$ relative to horizontal axis $A_H$. A Zero model Pulsar III blast cabinet from Clemco Industries of Washington, Mo. was used for the tests. The machine was operated according to standard operating procedures using a quarter inch nozzle and an aggregate feed rate of 3.12 cubic feet per hour. Silica glass beads were used as the aggregate, and the blast pressure was 60 psi. The blast angle $\alpha$ was 20°, making a 70° angle of impact relative to face 102. The duration of the blast tests was 40 minutes. The groove width prior to and after blasting was measured.

Figure 3:
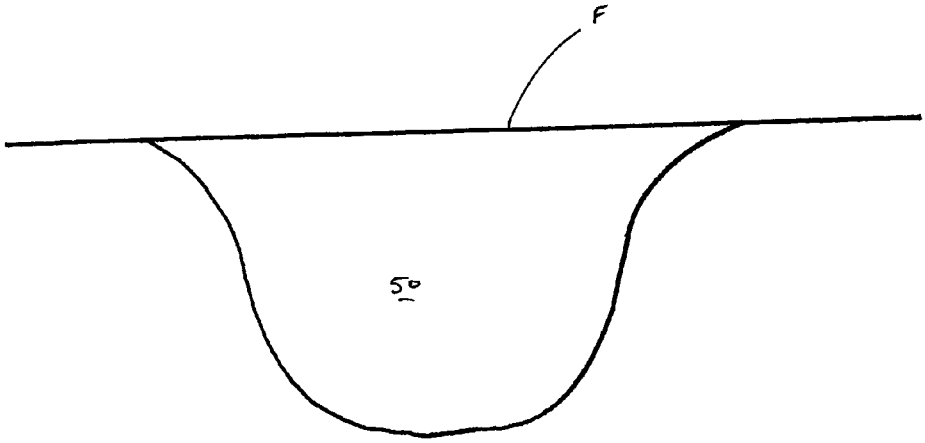
PRIOR ART FIGURE 3
FIG. 3 shows a side view of a groove of a known golf club before blast testing.
Figure 4:
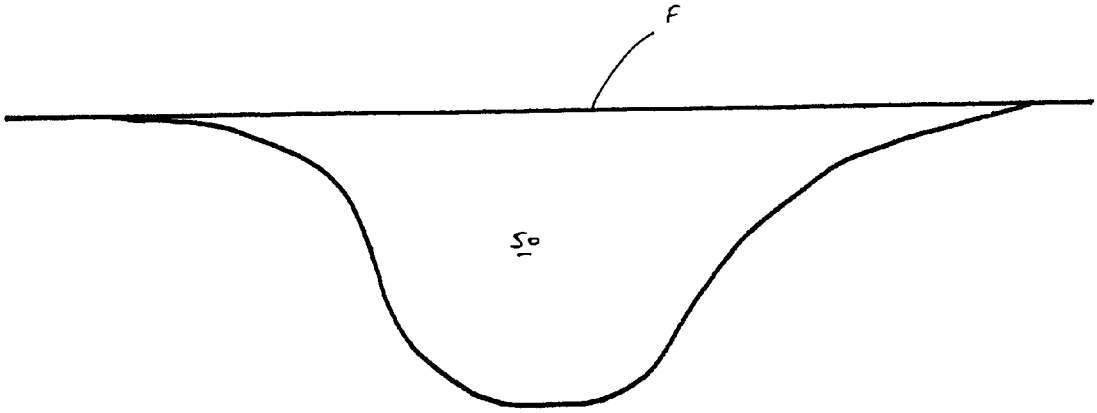
PRIOR ART FIGURE 4
FIG. 4 shows the groove of FIG. 3 after blast testing.

The first club tested was a Vokey wedge with a raw finish. The Vokey wedge is formed from an 8620 carbon steel without a protective chrome finish. Drawing figures showing pre-blast and post-blast groove profiles for the Vokey wedge are provided for illustrative purposes. FIG. 3 shows a side view of a groove 50 of a Vokey wedge prior to blast testing. The image has been magnified 80 times. Groove 50 has uniform dimensions and is generally U-shaped. A line F corresponding to the plane of the club face is shown for illustrative purposes. The width of groove 50 is 0.045". FIG. 4 shows a side view of groove 50 of the Vokey wedge after blast testing. Groove 50 has been enlarged considerably, especially at the groove-face transition, which is the portion of a groove that contacts and grips a golf ball during use. Groove 50 has a post-blast width of 0.082", an 82.2% increase.

The second club tested was a Vokey wedge with a chrome finish. This club had a pre-blast groove width of 0.051" and a post-blast groove width of 0.076", a 49.0% change.

The third club tested was a Ping wedge. The Ping wedge is formed from a typical 17-4 PH stainless steel. This club had a pre-blast groove width of 0.049" and a post-blast groove width of 0.072", a 56.9% change.

The final club tested was a wedge of the present invention. This club had a pre-blast groove width of 0.030" and a post-blast groove width of 0.036", a 20.0% change.

These results are summarized in Table 1 below:

TABLE 1

| Club | Pre-blast width (in.) | Post-blast depth (in.) | Percent change |
|---|---|---|---|
| Vokey wedge-raw finish | 0.045 | 0.082 | 82.2% |
| Vokey wedge-chrome finish | 0.051 | 0.076 | 49.0% |
| Ping wedge | 0.049 | 0.072 | 56.9% |
| Present invention | 0.030 | 0.036 | 20.0% |

The grooves 22 of club head 1 of the present invention preferably have a change in width of less than approximately 40% upon blast testing. More preferably, grooves 22 have a change in width of less than approximately 30% upon blast testing. Still more preferably, grooves 22 have a change in width of less than approximately 25% upon blast testing.

During development of the present invention, a correlation between wear resistance and material hardness was discovered. A preferred material for the second material is disclosed in U.S. Pat. No. 5,370,750 to Novotny et al., which is incorporated herein by reference in its entirety. Novotny discloses a material exhibiting a preferred combination of hardness and corrosion resistance.

Novotny discloses that its unique hardness and corrosion resistance result predominantly from its controlled proportions of carbon and chromium. Carbon contributes to the high hardness, so at least about 1.40%, and more preferably at least about 1.50%, carbon is present. Too much carbon adversely affects the corrosion resistance, so not more than about 1.75%, preferably not more than about 1.65%, carbon is present. For best results, the material contains about 1.58%-1.63% carbon. At least about 13.5%, preferably at least about 15.5%, chromium is present to benefit the corrosion resistance. Too much chromium adversely affects the hardness and restricts the solution treatment temperature to an undesirably narrow range, so not more than about 18.0%, preferably not more than about 16.5%, chromium is present. A summary of the preferred face composition is provided in Table 2, which was copied from table 1 of the Novotny reference.

TABLE 2

| Element | Broad range (%) | Preferred range (%) |
|---|---|---|
| C | 1.40-1.75 | 1.50-1.65 |
| Mn | 0.30-1.0 | 0.45-0.60 |
| Si | 0.80 max | 0.30-0.45 |

TABLE 2-continued

| Element | Broad range (%) | Preferred range (%) |
|---|---|---|
| P | 0.020 max | 0.020 max |
| S | 0.015 max | 0.015 max |
| Cr | 13.5-18.0 | 15.5-16.5 |
| Ni | 0.15-0.65 | 0.25-0.45 |
| Mo | 0.40-1.50 | 0.75-0.90 |
| V | 1.0 max | 0.40-0.50 |
| N | 0.02-0.08 | 0.04-0.06 |

The balance of the alloy is essentially iron, apart from the usual impurities.

Thus, the second material preferably includes approximately 1.40% to approximately 1.75% carbon and approximately 10.0% to approximately 18.0% chromium. More preferably, the second material includes approximately 1.50% to approximately 1.65% carbon and approximately 15.5% to approximately 16.5% chromium.

The carbon and chromium composition may also be expressed as a ratio. Per Novotny, the second material preferably comprises a ratio of percentage chromium to percentage carbon from approximately 10:1 to approximately 11:1. All percentages discussed herein are weight percentages.

As stated above, wear resistance has a correlation to material hardness. Thus, another way to categorize the first and second materials is by their absolute and relative hardnesses. The second material is harder than the first material. This relationship provides the needed face wear resistance while allowing club head customization to accommodate a golfer's unique swing. This relationship is opposite from most clubs with face inserts, which provide a softer face and a harder body.

Through testing, it was determined that a second material having a Rockwell C hardness of about 40 or greater would provide adequate face wear resistance. More preferably, face insert 20 has a Rockwell C hardness of about 50 to about 55. To allow for workability, the first material preferably has a Rockwell C hardness of about 30 or less.

Since sole 14 impacts the ground during normal use, it also experiences wear. Club head 1 may preferably include a sole insert 30 comprised of a third material. The third material is harder than the first material. The third material exhibits similar wear resistant properties and compositions as discussed above with respect to the second material. The third material may be substantially the same as the second material, or it may be different.

While the preferred embodiments of the present invention have been described above, it should be understood that they have been presented by way of example only, and not of limitation. It will be apparent to persons skilled in the relevant art that various changes in form and detail can be made therein without departing from the spirit and scope of the invention. Thus the present invention should not be limited by the above-described exemplary embodiments, but should be defined only in accordance with the following claims and their equivalents.

What is claimed is:

1. An iron-type golf club head, comprising:

a body comprising a first material comprising steel;

a face insert coupled to said body, said face insert comprising a second material; and a sole coupled to said body, said sole comprising a third material different from the first and second materials;

wherein said second material comprises a steel alloy having a wear resistance from approximately 40 or less, and wherein the first material has an elongation of greater than approximately 13 percent and is softer than the second and third materials.

2. The golf club head of claim 1, wherein said second material has a wear resistance of approximately 35 or less.

3. The golf club head of claim 1, wherein said first material has a Rockwell C hardness of approximately 30 or less.

4. The golf club head of claim 1, wherein said first material has an ultimate elongation of approximately 15% to approximately 21%.

5. The golf club head of claim 1, wherein second material has a Rockwell C hardness of approximately 40 or more.

6. The golf club head of claim 1, wherein said face insert has grooves formed therein.

7. A golf club head, comprising:

a body comprising a first steel material;

a face insert coupled to said body, said face insert comprising a second steel material, said face insert including a strike face having grooves therein; and a sole comprising a third material different from the first steel material and second steel material;

wherein the second steel material and third material are harder than the first steel material, wherein said grooves have a width, said width changing less than approximately 40% upon blast testing.

8. The golf club head of claim 7, wherein said width changes less than approximately 30% upon blast testing.

9. The golf club head of claim 8, wherein said width changes less than approximately 25% upon blast testing.

10. An iron-type golf club head, comprising:

a body comprising a first material comprising steel;

a face insert coupled to said body, said face insert comprising a second steel material comprising 0.15 to 0.65% nickel, 10.0 to 18.0% chromium, and 1.40 to 1.75% carbon by weight of the second steel material, said face insert including a strike face; and a sole comprising a third material different from the first material and second steel material;

wherein said first material is softer than said second material and said third material, wherein the second steel material has a Rockwell C hardness of approximately 50 to approximately 55.

11. The golf club head of claim 10, wherein said first material has a Rockwell C hardness of at most approximately 30.

12. The golf club head of claim 10, wherein said first material has an ultimate elongation of at least about 13%.

13. The golf club head of claim 10, wherein said face insert has grooves formed therein.

14. A golf club head, comprising:

a body comprising a first steel;

a face insert coupled to said body, said face insert comprising a second steel; and a sole insert coupled to said body, said sole insert comprising a material harder than the first steel and different from the second steel;

wherein said second steel includes approximately 1.40% to approximately 1.75% carbon and approximately 10.0% to approximately 18.0% chromium by weight of the second steel.

15. The golf club head of claim 14, wherein said second steel includes approximately 1.50% to approximately 1.65% carbon by weight of the second steel.

16. The golf club head of claim 14, wherein said second steel includes approximately 15.5% to approximately 16.5% chromium by weight of the second steel.

17. The golf club head of claim 14, wherein said second steel includes approximately 1.50% to approximately 1.65% carbon and approximately 15.5% to approximately 16.5% chromium by weight of the second steel.

18. The golf club head of claim 14, wherein said second steel comprises a ratio of percentage chromium to percentage carbon from approximately 10:1 to approximately 11:1.

19. The golf club head of claim 14, wherein said second steel has a Rockwell C hardness of approximately 50 to approximately 55.

20. The golf club head of claim 14, wherein said face insert includes a strike face having grooves formed therein.

21. The golf club head of claim 14, wherein said first steel has an elongation of greater than approximately 13%.

22. The golf club head of claim 14, wherein said first steel has a Rockwell C hardness of approximately 30 or less.

23. The golf club head of claim 14, wherein said first steel has an ultimate elongation of approximately 15% to approximately 21%.

* * * * *